US006786170B2

(12) United States Patent
Trowbridge

(10) Patent No.: US 6,786,170 B2
(45) Date of Patent: Sep. 7, 2004

(54) BOAT LIFTING DEVICE

(76) Inventor: David L. Trowbridge, 1203 Andre Ave., Mountain View, CA (US) 94040

( * ) Notice: Subject to any disclaimer, the term of this patent is extended or adjusted under 35 U.S.C. 154(b) by 0 days.

(21) Appl. No.: 10/417,385

(22) Filed: Apr. 16, 2003

(65) Prior Publication Data

US 2003/0192466 A1 Oct. 16, 2003

Related U.S. Application Data

(60) Provisional application No. 60/373,295, filed on Apr. 16, 2002.

(51) Int. Cl.[7] ..... B63B 35/40

(52) U.S. Cl. ..... 114/259

(58) Field of Search ..... 114/259, 369, 114/258, 260, 268, 365

(56) References Cited

U.S. PATENT DOCUMENTS

| | | | | |
|---|---|---|---|---|
| 252,198 | A | | 1/1882 | Earle |
| 2,091,327 | A | | 8/1937 | McPartland |
| 2,433,858 | A | | 1/1948 | Maxson |
| 2,782,744 | A | | 2/1957 | Staley |
| 4,627,377 | A | | 12/1986 | Zoonens |
| 4,878,450 | A | | 11/1989 | Schmidt, Jr. |
| 5,170,742 | A | | 12/1992 | Roskelley |
| 5,544,606 | A | | 8/1996 | Schmidt, Jr. |
| 6,327,992 | B1 | * | 12/2001 | Martin ..... 114/259 |
| 6,474,256 | B1 | * | 11/2002 | Vogel ..... 114/368 |

* cited by examiner

*Primary Examiner*—Ed Swinehart
(74) *Attorney, Agent, or Firm*—Burns Doane Swecker & Mathis, LLP

(57) ABSTRACT

In accordance with the present invention there is provided a lifting device for a boat, the lifting device including a first platform and a plurality of linkage members, the plurality of linkage members configured to form at least two four-bar linkage assemblies, each having a first end pivotally attached to the platform and a second end pivotally attached to a boat. The lifting device further including at least one hydraulic cylinder, the cylinder having a first end and second end, the first end being pivotally affixed to the structure of a boat and the second end pivotally attached to at least one linkage member, and a fluid device in communication with the hydraulic cylinder. A load sharing member connects the two four-bar linkage assemblies and prevents uneven or tilted motion of the platform.

36 Claims, 8 Drawing Sheets

BOAT LIFTING DEVICE

CROSS-REFERENCE TO RELATED APPLICATIONS

This application claims priority under 35 U.S.C. § 119 to U.S. Provisional Application No. 60/373,295 entitled BOAT LIFTING DEVICE and filed on Apr. 16, 2002, the entire content of which is hereby incorporated by reference.

FIELD OF THE INVENTION

The present invention relates to devices for lifting boats or personal watercraft. More specifically, the present invention relates to a hydraulicly operated platform that may be secured to a boat or a structure. Further still, the present invention improves upon available boat lifts by providing a boat lift that is capable of raising and lowering the platform in a substantially horizontal manner.

BACKGROUND OF THE INVENTION

Boat lifts have long been available for use with large luxury watercraft such as personal yachts where boat lifts are utilized to raise and lower a smaller boat or dinghy that could be used to transport people to and from shore where the yacht had to be anchored offshore. With the increased popularity of personal watercraft such as JetSkis® or Waverunners® there is an increased need for a boat lift that is capable of raising and lowering these personal watercraft in and out of the water. Although there are many boat lifts available, many have substantial shortcomings or are too large to be attached to a pleasure craft such as a yacht or a house boat. Further still, many of the boat lifts were designed to raise and lower small inflatable boats or dinghies where weight distribution is not an important consideration.

Many of the presently available boat lifts utilize at least one hydraulic cylinder, or more likely two hydraulic cylinders operating in tandem to raise and lower the platform. Although, the two hydraulic cylinders are capable of providing the forces necessary to raise and lower the platform, many times the platform is not sufficiently rigid. Thus, when a personal watercraft is disposed upon the platform and the hydraulic cylinders are activated to lift the platform, many times the platform will lift at an angle due to the unbalanced weight disposed on the platform. This unbalanced condition makes it difficult for a person to stand on the platform because the unbalanced condition makes it unsafe.

As described above, many of the lifting devices available on the market utilize a platform and two hydraulic cylinders, where the hydraulic cylinders are connected to the platform. A problem associated with this type of layout is that the two hydraulic cylinders are only coupled together through the platform. In use, if the load placed on the platform is not equally balanced, one cylinder will lift the platform faster than the other cylinder. Therefore, as the platform ascends or descends it does so tipped at an angle. This tipping creates a dangerous situation because the boat or personal watercraft disposed upon the platform may slide off of the platform and cause injury to someone located nearby. Additionally, this tipping condition makes it difficult for a person to stand on the platform when the platform is being raised or lowered and may cause the platform to drag in the water when in a raised position. Further still, this tipping condition may not allow a locking mechanism to be activated, thus requiring additional steps to lock the platform into a safe position.

In addition to providing a lifting platform for a personal watercraft or boat, many times the boat lifting platforms may be utilized as a recreational device, such as a swimming platform, or a means for entry into the boat to which the platform is attached. Further still, many platforms include a support device for cradling a small boat or personal watercraft, these cradles are sometimes fixedly attached to the platform, thus making it difficult to use the platform for recreational purposes. Thus, it is desirable to provide a platform that is sufficiently rigid to be utilized as a swimming platform.

Furthermore, it is desirable to provide an improved lifting platform that is capable of providing a stable lifting platform for a personal watercraft or boat in addition to providing easier egress and departure to/from the boat or structure to which the lifting platform is attached.

SUMMARY OF THE INVENTION

In accordance with the present invention there is provided a lifting device for a boat, the lifting device includes a first platform and a plurality of linkage members, the plurality of linkage members configured to form at least two four-bar linkage assemblies, each four-bar linkage assembly having a first end pivotally attached to the first platform and a second end pivotally attached to a boat and at least one load sharing member configured to span and connect to at least two of the four-bar linkages together so that in use forces exerted by a hydraulic cylinder on the four-bar linkage is shared equally. The lifting device further includes at least one hydraulic cylinder, the cylinder having a first end and second end, the first end being pivotally connectable to the structure of a boat and the second end pivotally attached to at least one linkage member, and a fluid device in communication with the hydraulic cylinder.

In accordance with another aspect in accordance with the present invention there is provided a lifting device for lifting a personal watercraft or boat, the lifting device includes a first platform and a plurality of linkage members, the plurality of linkage members configured to form at least two four-bar linkage assemblies, each four-bar linkage having a first end pivotally attached to the platform and a second end pivotally attached to a boat. At least two force applying devices configured to raise and lower the two four-bar linkage assemblies, each force applying device having a first end and second end, the first end being pivotally connectable to the structure of a boat and the second end pivotally attached to at least one linkage member. The lifting device further includes a second platform, the second platform pivotally connected to the two four-bar linkage assemblies, and a control device in communication with the two force applying devices, the control device configured to control the motion of the each of the two force applying devices.

In accordance with yet another aspect of the present invention there is provided a lifting device for lifting a personal watercraft or boat, the lifting device includes a first platform and a second platform, a plurality of linkage members being pivotally connected to the first and second platforms. At least one force applying device configured to raise and lower the first and second platforms, the force applying device having a first end and second end, the first end being pivotally connectable to a boat and the second end pivotally connected to at least one linkage member, and a control device in communication with the force applying device, the control device configured to control the motion of the force applying device, whereby the force applying device and control device are configured to move both the first platform and the second platform from a raised position to a lowered position, wherein when the second platform is moved from a raised position to a lowered position, the second platform is moved less than half a distance the first platform is moved from the raised position to the lowered position.

BRIEF DESCRIPTION OF THE DRAWINGS

The features of the present invention are illustrated in the appended drawings, wherein like numeral have been utilized to denote the same or similar features, in which.

DETAILED DESCRIPTION

In accordance with the present invention there is provided a lifting device configured to be connected to a boat. The lifting device includes a platform, wherein the platform is configured to receive a boat or personal watercraft thereon.

Figure 1:
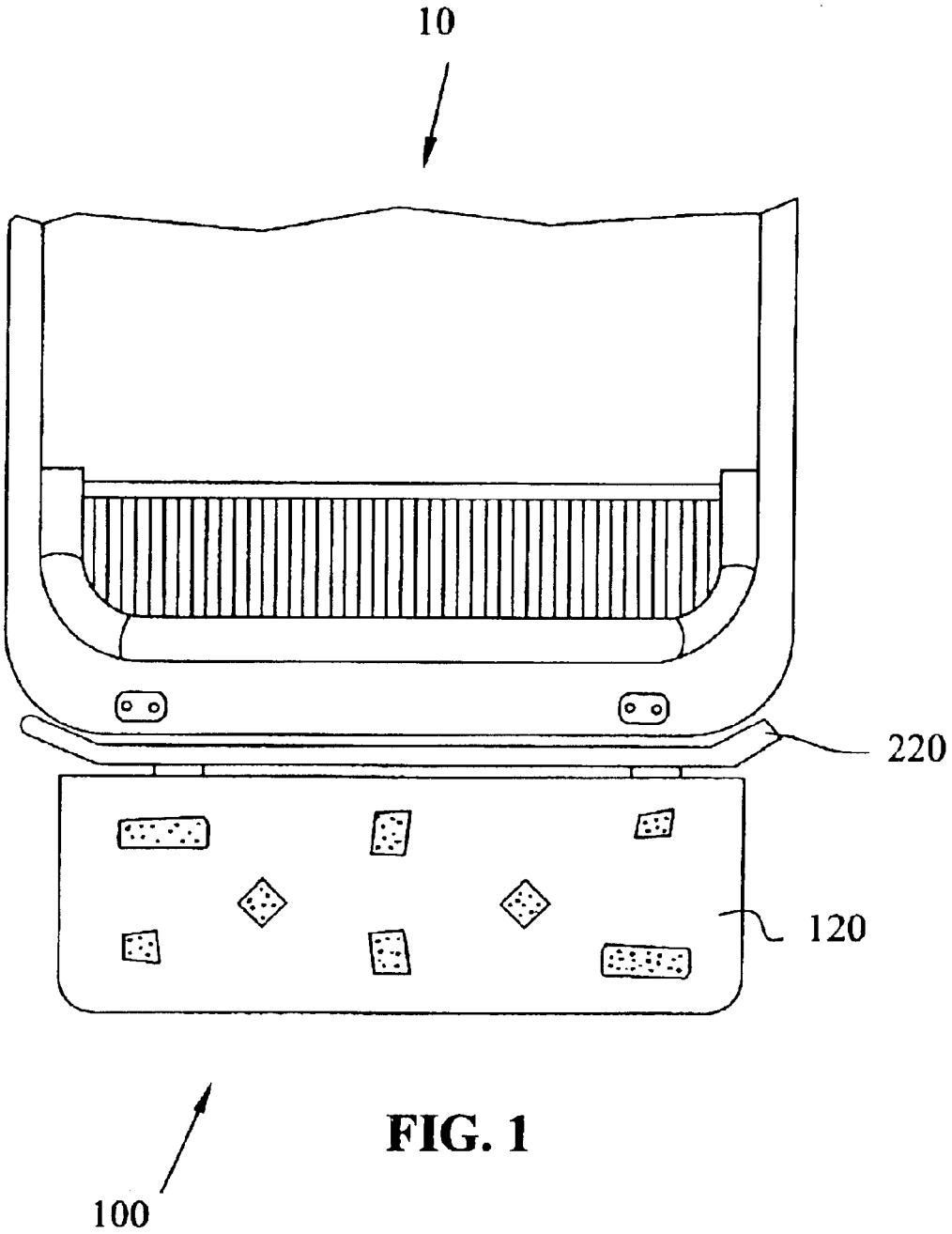
FIG. 1 is a top view of the lifting device in accordance with the present invention.

Referring now to FIG. 1, there is shown a top view of the lifting device 100 in accordance with the present invention. As shown in FIG. 1, the lifting device is configured to be attached to the transom of a boat 10. The boat 10 may be a pleasure craft such as a luxury yacht, sailboat, or other similar types of boats.

Figure 2:
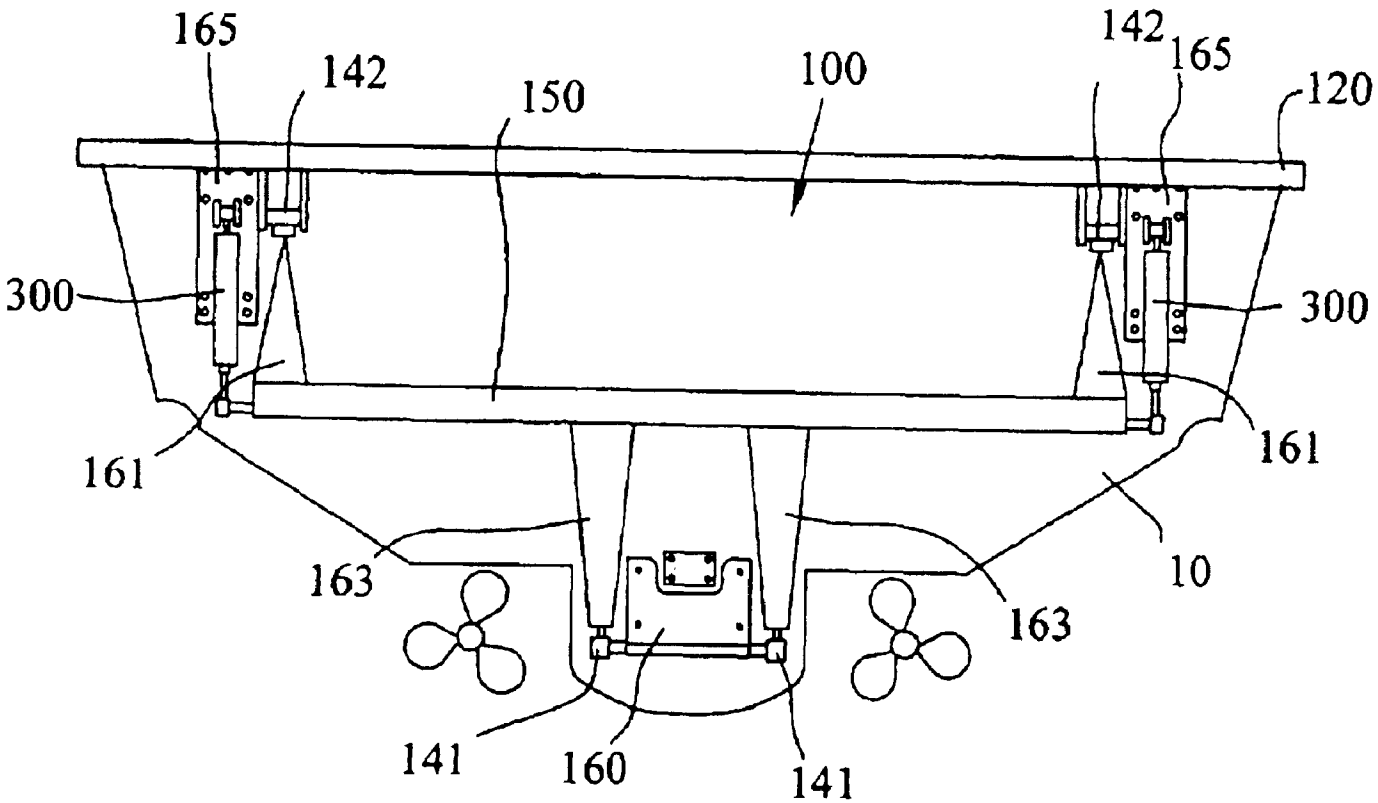
FIG. 2 is an end view of the lifting device in accordance with the present invention.

Referring now to FIG. 2, there is shown an end view of a boat 10 including the lifting device 100 in accordance with the present invention. As shown in FIG. 2, the lifting device 100 is fixedly attached to the transom of the boat 10 through attachment members 160 and 165. The lifting device 100 is shown disposed in a raised position, wherein the first platform 120 is raised to a position that is substantially parallel to the deck surface of the boat 10 to which the lifting device 100 is attached.

Figure 3:
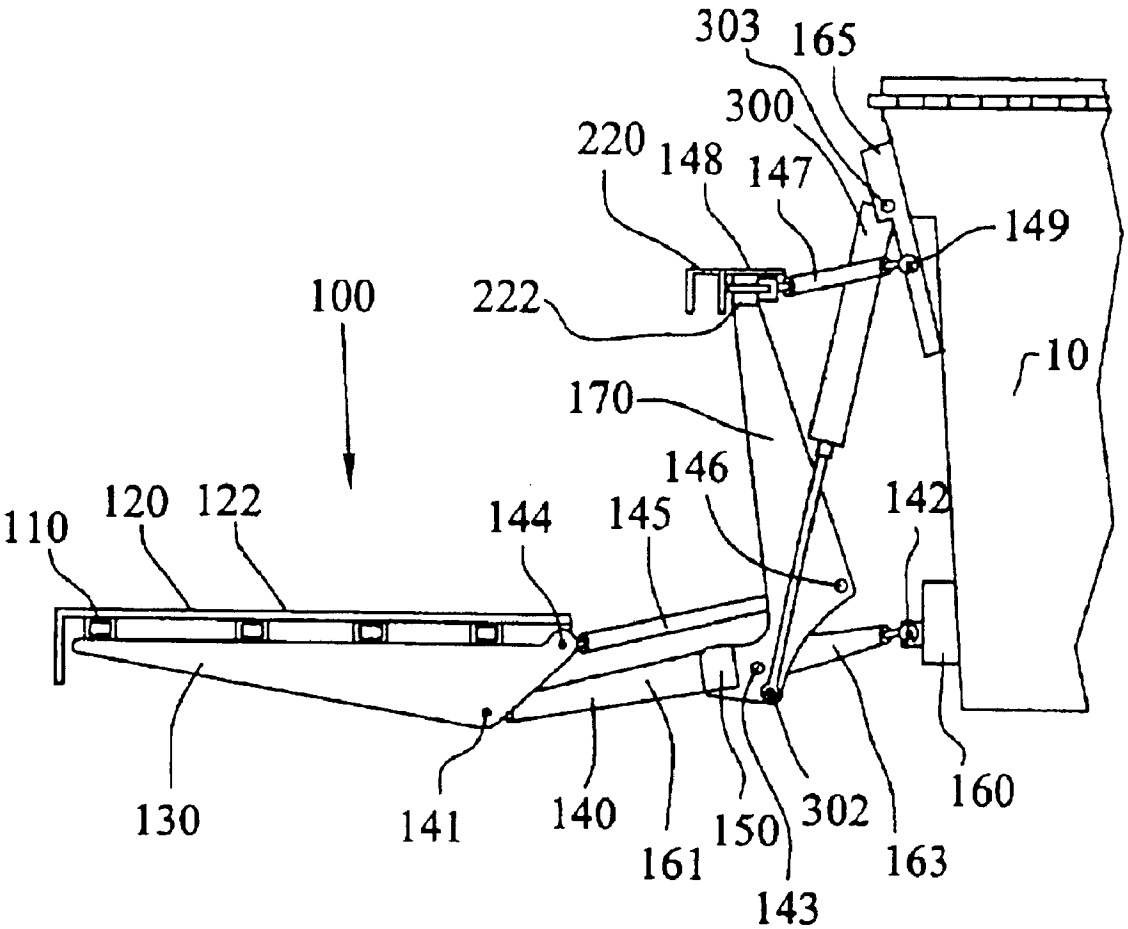
FIG. 3 is a side view of the lifting device in accordance with the present invention wherein the lifting device is disposed in a lowered position.

Referring now to FIG. 3, there is shown a side view of the lifting device 100 in accordance with the present invention. As shown in FIG. 3, the lifting device 100 is disposed in a lowered position, wherein a boat or personal watercraft can be loaded/unloaded from the first platform 120. As shown in FIG. 3, the lifting device includes a first platform 120 connected to a plurality of linkage members 140, 145, 147 and 170. The plurality of linkage members 140, 145, 147 and 170 form two four-bar linkage systems or parallelogram linkages connected to each side of the first platform 120 which raise and lower the first platform 120. In a preferred embodiment, linkage members 140, 145, 147, and 170 are constructed of stainless steel. However, it can be appreciated that other materials such as aluminum, steel, composite materials, titanium or similar corrosion resistance materials can be used.

As shown in FIG. 3, the first platform 120 comprises a substantially horizontal member having an upper surface 122 for receiving a smaller boat or watercraft. The first platform 120 includes a plurality of support members 110 and a platform support member 130. The plurality of support members 110 provide support to the first platform 120 by extending between the two sets of four-bar linkage assemblies and the platform support member 130. The support members 110 are also connected to the platform support member 130. The first platform 120 may be constructed of materials such as fiberglass, plastics, carbon fiber, kevlar, aluminum, stainless steel, titanium, or similar corrosion resistant materials. The first platform 120 and support members 110 are configured to span the length of the lifting device 100 and connect the two four-bar linkage assemblies.

The platform support member 130 is configured to be connected to the end of the support members 110 and extends beneath the upper surface 122 of the lifting device 100. The platform support member 130 provides a first end 141, 144 for receiving linkage members 140, 145. The second end of the platform support member 130 is fixedly connected to a distal end (or end furthest from the boat) of the lifting device 100. The linkage members 140, 145 are pivotally attached to the platform support member 130, thereby allowing the platform support member 130 to move relative to linkage members 140 and 145. Linkage member 145 is pivotally connected to linkage member 170 for supporting a second platform 220, wherein one end of the linkage member 170 is connected to the linkage member 140, the second end of linkage member 170 being connected to the second platform 220 and linkage member 147. The second end 149 of linkage member 147 is attached to an attachment member 165, the attachment member 165 configured to be coupled to a boat or other structure.

As shown in FIG. 3, linkage member 140 is pivotally connected at a first end 141 to the platform support member 130 and pivotally connected at a second end 142 to an attachment element 160, wherein the attachment element is configured to be attached to a boat or other structure. The linkage member 140 is further configured to receive a load sharing member 150, wherein the load sharing member 150 is configured to extend across the width of the lifting device 100 and connect a first four-bar linkage assembly at one side of the boat to a second four-bar assembly at the opposite side of the boat. The function of the load sharing member 150 will be described in greater detail below with reference to the function of the lifting device 100.

Furthermore, as shown in FIG. 3, the linkage member 140 is further configured to pivotally receive linkage member 170, wherein a portion of linkage member 140 forms a portion of a four-bar linkage assembly. Linkage member 140 preferably includes a first section 161 and a second section 163. The first section 161 of linkage member 140 is pivotally connected to the platform support member 130 at the first end 141 and extends to the load sharing member 150, where it is fixed to the load sharing member 150. The second section 163 of linkage member 140 is fixed to the load sharing member 150 and extends from the load sharing member 150 to the second end 142. The second section 163 of the linkage member 140 is pivotally connected at the second end 142 to an attachment member 160. The attachment element 160 is configured to be attached to a boat or other structure.

In a preferred embodiment, as shown in FIG. 3, linkage member 170 extends from the second platform support member 222 to linkage member 140 and linkage member 145. The linkage member 170 is fixed to the second platform 220 at the second platform support member 222. A second end 143 of linkage member 170 is pivotally connected to the second section 163 of linkage member 140. Meanwhile, a third end 146 of linkage member 170 is pivotally connected to linkage member 145.

The second support member 220 is pivotally connected to linkage member 147 at a first end 148. The linkage member 147 is pivotally attached at a second end 149 to an attachment member 165. The attachment member 165 is configured to be coupled to a boat or other structure.

Furthermore, as shown in FIG. 3, linkage member 140 is further configured to pivotally receive linkage member 170, wherein a portion of linkage member 140 forms a portion of a four-bar linkage assembly.

Additionally, as shown in FIG. 3, the linkage member 140 further includes means adapted for receiving a first end 302 of a hydraulic cylinder 300. The first end 302 of the hydraulic cylinder 300 is pivotally attached to the linkage member 140. The second end 303 of the hydraulic cylinder 300 is pivotally attached to the attachment member 165, the attachment member 165 being configured to be attached to the transom of a boat or other structure. The use of hydraulic cylinders 300 as the force applying device herein should not be considered limiting in any manner, as it is contemplated that other force applying devices may be utilized in accordance with the present invention. For example, the hydraulic cylinders 300 may be replaced with linear actuators, a motor and screw assembly, or other similar mechanical devices. Additionally, although the present invention is illustrated as having two four-bar linkage assemblies disposed on either side of the platform, it shall be understood that the lifting device 100 in accordance with the present invention may be configured to function in the same manner utilizing only a single four-bar linkage assembly. The single four-bar linkage assembly may be disposed at either end of the platform or disposed at any position therebetween.

It shall be understood that the elements as described above comprise one of two or more four-bar linkage assemblies in accordance with the present invention. As shown in FIGS. 1–4, the lifting device 100 in accordance with the present invention utilizes two pairs of four-bar assemblies, wherein the two pairs of four-bar assemblies are connected to each other through the first platform 120, the load sharing member 150, and the second platform 220. It shall also be understood that the second platform 220 may not be utilized in accordance with a preferred embodiment of the present invention. The second platform 220 may be constructed of the same or similar materials as the first platform 120.

Figure 4:
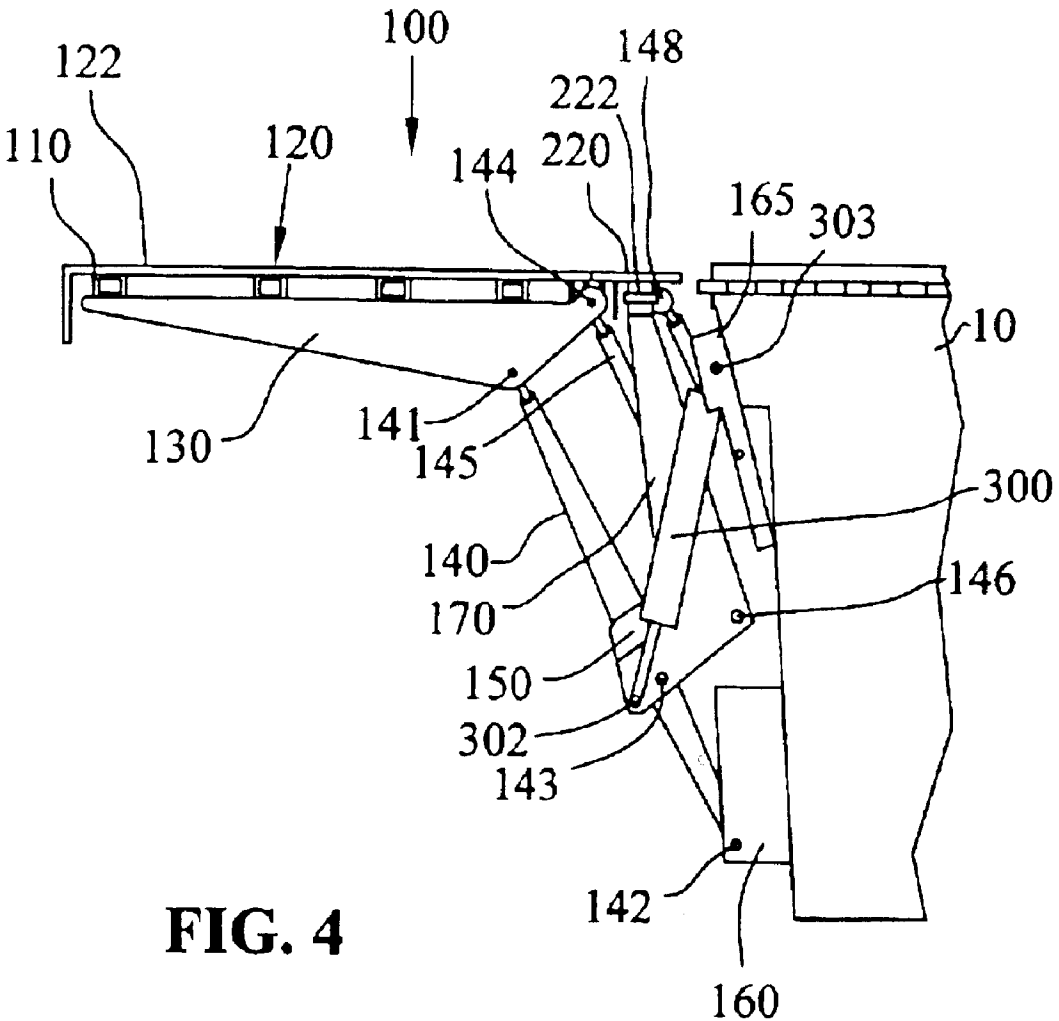
FIG. 4 is a side view of the lifting device in accordance with the present invention wherein the lifting device is disposed in a raised position.

According to one preferred embodiment of the invention, each pair of four-bar linkages includes a first four-bar linkage connected to the boat which acts as a parallelogram linkage to raise and lower the second platform 220. The first four-bar linkage, as shown in the embodiment of FIGS. 3 and 4, includes linkage members 147 and 170, the second section 163 of the linkage member 140, and the rear of the boat. A second four-bar linkage is connected to the first four-bar linkage and maintains the first platform 120 horizontal at all vertical positions. The second four-bar linkage includes the linkage member 145, a portion of the platform support member 130 extending between the first end 141 of linkage member 141 and the first end 144 of linkage member 145, the first section 161 of the linkage member 140, and a lower portion of the linkage member 170 extending between the second end 143 and the third end 146. The first four-bar linkage and the second four-bar linkage work together to move the first platform 120 up and down while maintaining the platform level. The second platform 220 is moved up and down solely by the first four-bar linkage.

As shown in FIG. 3 and described above, the lifting device 100 is shown in an extended/lowered position, wherein the first platform 120 is configured for the loading or unloading of a boat or personal watercraft. The lifting device 100 maybe disposed between a lowered and a raised position through the use at least two hydraulic cylinders 300. The hydraulic cylinder 300 is pivotally connected at the second end 303 to a fixed surface such as an attachment member 165 affixed to a boat or structure and pivotally connected at a first end 302 a four-bar linkage assembly, the four-bar linkage assemblies connected to the first and second platforms 120, 220, and configured to raise/lower the platforms. The two hydraulic cylinders 300 for lifting the two sides of the first and second platforms 120, 220 are connected to a single pressurized fluid device (not shown) onboard the boat. The pressurized device source may comprise a hydraulic pump configured to provide pressurized fluid to the hydraulic cylinder 300. In an alternative embodiment, the hydraulic pump may be independently driven by a power source separate from the boat's motor. In a preferred embodiment, the hydraulic pump is powered from the boat's motor or battery. In addition to a hydraulic pump, the lifting device 100 further includes a control device (not shown). The control device is configured to control the motion of the hydraulic cylinders. The control device may include a conventional lever-operated control valve system wherein the levers are configured to be pushed or pulled to control fluid in/out of the cylinders. Alternatively, the control system may comprise an electromechanical system wherein a keypad or switches are connected to series of valves to control the flow of the pressurized fluid. For example, the keypad may be comprised as a rubber membrane-covered assembly that is waterproof or water resistant, thereby allowing an operator to control the motion of the platform from the first platform or the second platform.

Referring now to FIG. 4, there is shown a side view of the lifting device 100 in accordance with the present invention wherein the first platform 120 is disposed at a raised position. As shown in FIG. 4, the first platform 120 is raised to a position that is substantially parallel to the deck surface of the boat 10 to which the lifting device 100 is attached. Additionally, as shown in FIG. 4, the first platform 120 is retained in a substantially horizontal position relative to the water surface. As the first platform 120 is raised from a lowered position as that shown in FIG. 3 to a raised position as shown in FIG. 4, the first platform 120 travels through a generally circular path. That is, as the first platform 120 is raised by the contraction of the hydraulic cylinders 300, the first platform 120 is lifted from the surface of the water and moves in an upward and forward position relative to the transom of the boat 10. Though, as the first and second platforms 120, 220 are translated from one position to another position, the four-bar linkage assemblies maintain the first and second platforms 120, 220 in a substantially horizontal manner. That is, as the first and second platforms 120, 220 are raised/lowered the linkage members are maintained having substantially parallelogram geometry.

As shown in FIG. 4, the linkage members 140, 145, 147 and 170 are configured to lift the first platform 120 to a height above the water level and generally equal to that of the boat 10 to which the first platform 120 is attached. It shall be understood that the height to which the first platform 120 is raised may be adjusted by varying the length of the linkage members 140, 145, 147 and 170, or mounting the lifting device 100, on adjustable mounts that are affixed to the transom of the boat 10, wherein the adjustable mounts may be raised and lowered.

Referring now to FIGS. 3 and 4, there is shown a load sharing member 150 connected to the linkage member 140. The load sharing member 150 is configured to tie together two separate four-bar linkage assemblies and the first and second platforms 120, 220 such that when a boat or personal watercraft is placed on the first platform 120 and the hydraulic cylinders 300 are activated to raise or lower the first platform 120, the load sharing member 150 ensures that each side of the first platform 120 is raised at the same rate. Thus, when the first platform 120 is raised or lowered it is raised or lower in a substantially horizontal manner. This is unlike conventional boat lifts available, wherein they rely upon the platform to balance the lifting forces of the hydraulic cylinders, which many times due to an uneven load placed on the platform results in the platform being raised tipped at an angle and the platform dragging in the water on one side.

It shall be understood that the load sharing member 150 shall be constructed of a material that is sufficiently strong to balance the forces applied to the first platform 120. In a preferred embodiment the load sharing member 150 is fixedly attached to linkage member 140. The load sharing member 150 may be fixedly attached using known methods such as welding, bolting, friction fit, or similar methods. The load sharing member 150 can be a bar with a square cross section or any other type of bar.

As shown in FIGS. 3 and 4, the lifting device 100 in accordance with an exemplary embodiment of the present invention includes a second platform 220. The second platform 220 is pivotally connected to the four-bar linkage assemblies as described above with reference to FIG. 3. As shown in FIGS. 3 and 4, the second platform 220 assembly is configured to move in conjunction with the first platform 120. That is, when the first platform 120 is moved from a raised position as shown in FIG. 4 to a lowered position as shown in FIG. 3, the second platform 220 is configured to move down and away from the boat 10. By moving down and away from the boat in the manner illustrated, the second platform 220 provides a stepping area for a person to exit/enter the boat to/from the first platform 120. As described above the second platform 220 is configured to move relative to the motion of the first platform 120, in a preferred embodiment the second platform 220 moves a distance less than half of that of the first platform 120 when the first platform 120 is moved from a raised position to a lowered position.

Figure 5:
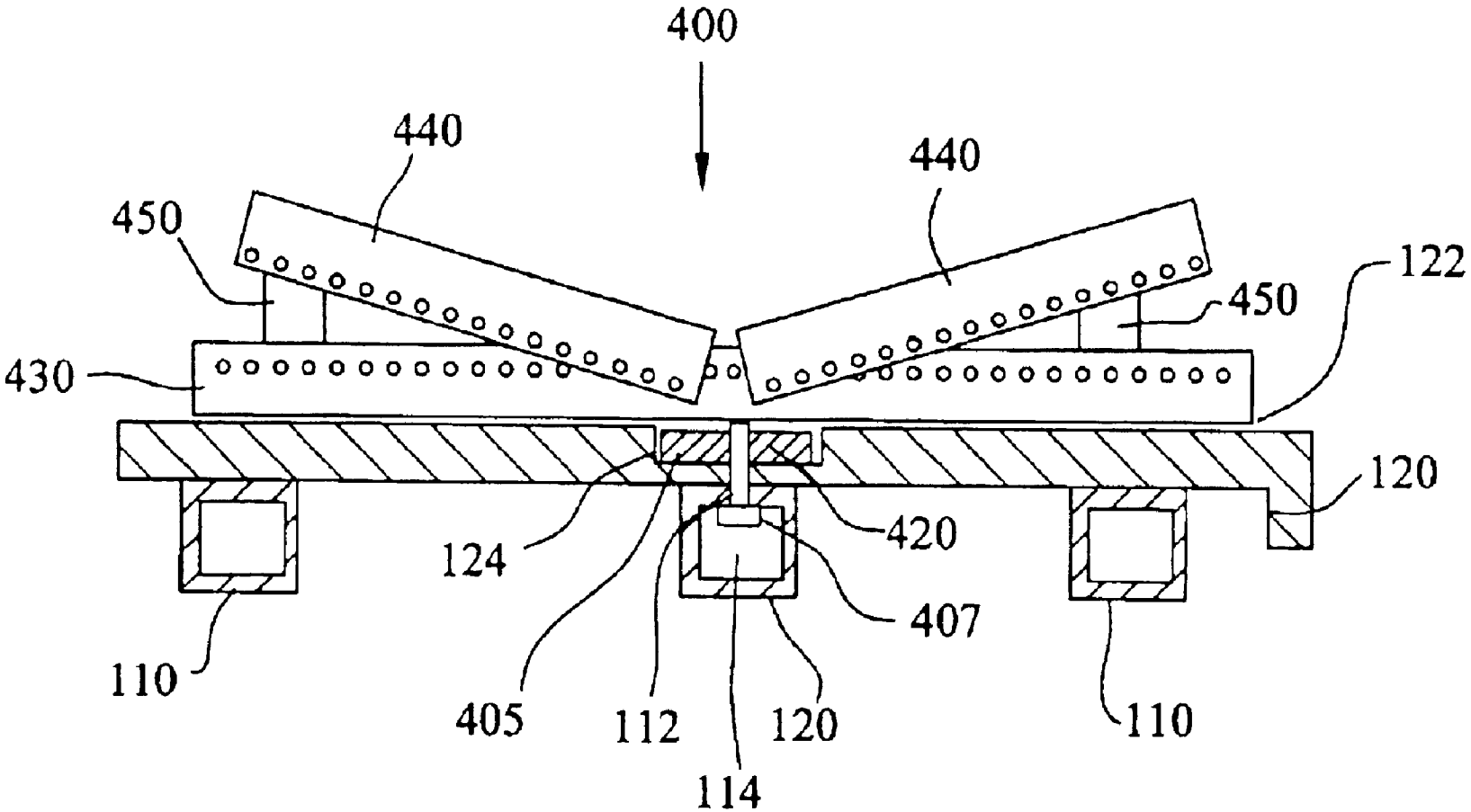
FIG. 5 is a cross-sectional view of the platform including the boat supporting device.

Referring now to FIG. 5, there is shown an exemplary embodiment of a boat supporting device 400 in accordance with the present invention. As shown in FIG. 5, the boat supporting device 400 includes a base member 430, an adjustable hull support member 440, and an angle adjustment member 450. As shown in FIG. 5, the boat supporting device 400 is configured to be received upon the upper surface 122 of the first platform 120. The first platform 120 is configured to receive an anchoring plate 405 within a recess 124 formed in the first platform 120. Thus, the anchoring plate 405 does not protrude above the upper surface 122 of the first platform 120. The recess 124 and the anchoring plate 405 are configured to be disposed over a platform support member 110, wherein the platform support member 110 further includes at least one aperture 112 formed therein, wherein the aperture 112 is aligned with an aperture 420 formed in the anchoring plate 405. Additionally, a nut 407 may be fixedly attached within an inner chamber 114 of the platform support member 110, wherein the nut 407 is configured to receive attachment means disposed through the aperture 420 of the anchoring plate 405.

Figure 6:
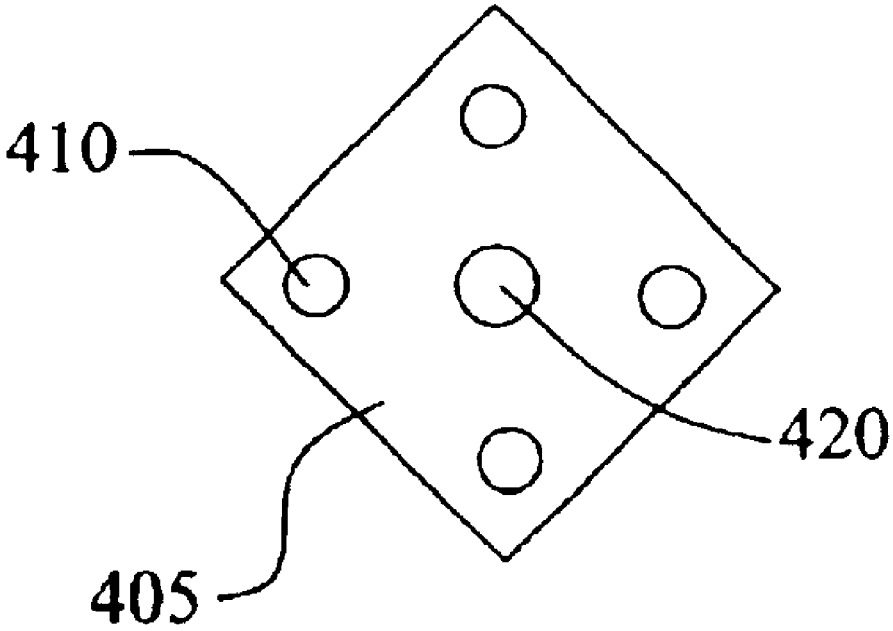
FIG. 6 is a plan view of the anchoring device of the boat supporting device.

Referring now to FIG. 6, there is shown the anchoring plate 405 in accordance with the present invention. As shown in FIG. 6, the anchoring plate comprises a substantially planar member having at least one aperture 420 disposed within the middle of the anchoring plate 405. A plurality of apertures 410 may be disposed about the perimeter of the plate, wherein anchoring means may be disposed within the plurality of apertures 410 to attach the anchoring plate 405 to the first platform 120.

Figure 7:
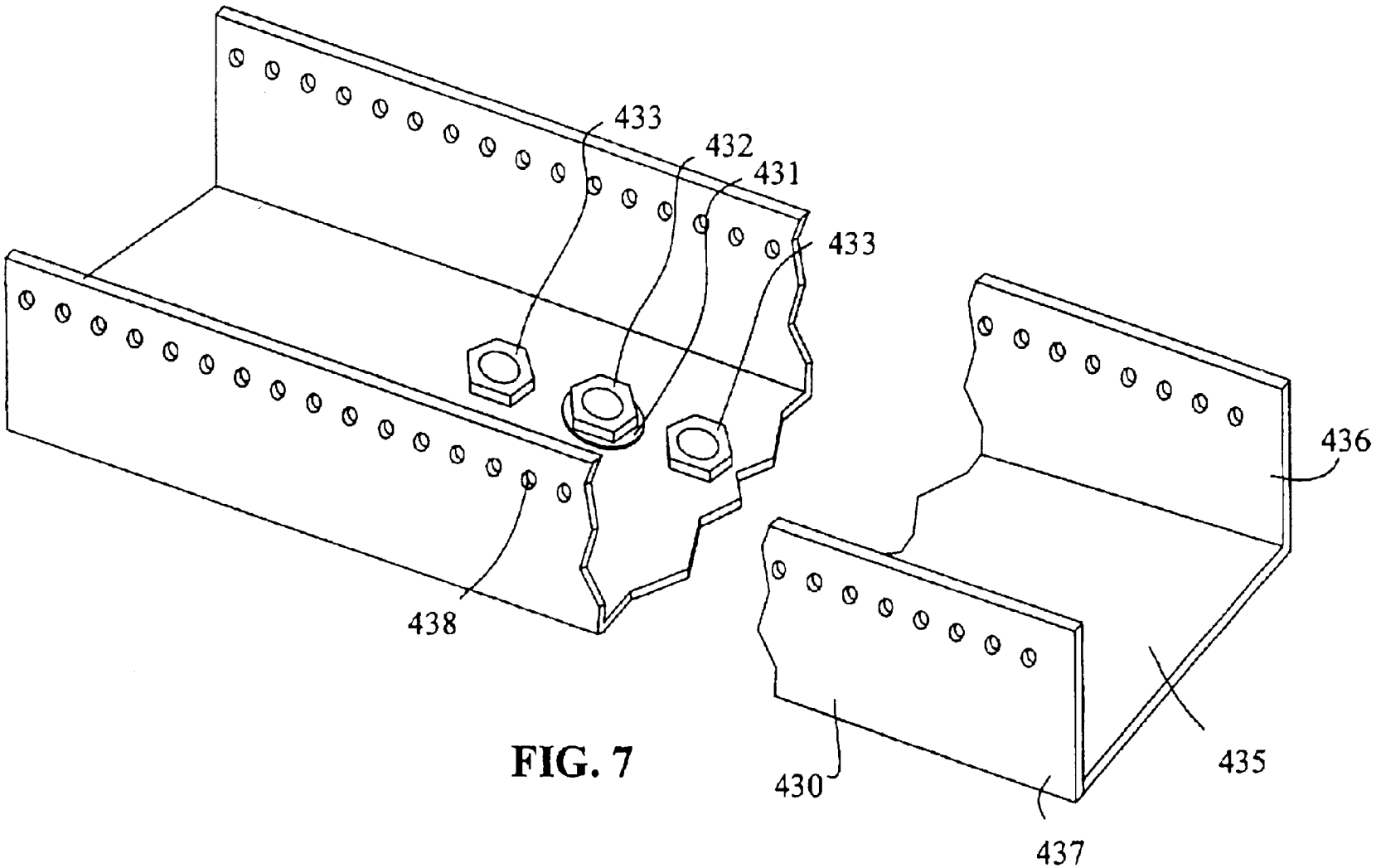
FIG. 7 is a perspective view of the base member of the boat supporting device.

Referring now to FIG. 7, there is shown a perspective view of the base member 430 in accordance with the present invention. As shown in FIG. 6, the base member 430 comprises a generally U-shaped channel having a bottom surface 435 and first and second sides 436 and 437. A plurality of apertures 438 are formed within the first and second sides 436 and 437 along the length of the base member 430. Further still, the base member 430 further includes apertures 433 and an anchoring aperture 432 formed within the bottom surface 435. The anchoring aperture 432 may further include a nut 431 disposed radially thereabout and fixedly attached to the bottom surface 435 utilizing known attachment methods such as welding, brazing, adhesives, or other similar attachment processes. The base member 430 may be formed of materials such as steel, aluminum or composite materials. In a preferred embodiment the base member 430 is formed of stainless steel.

Figure 9:
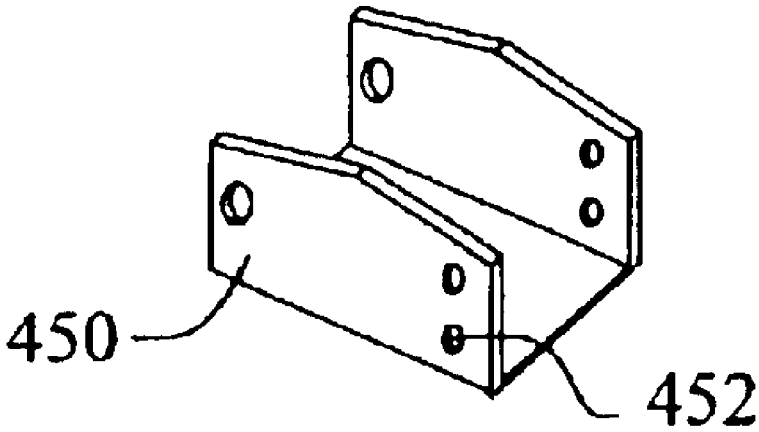
FIG. 9 is a perspective view of the angle support member of the boat supporting device.
Figure 8:
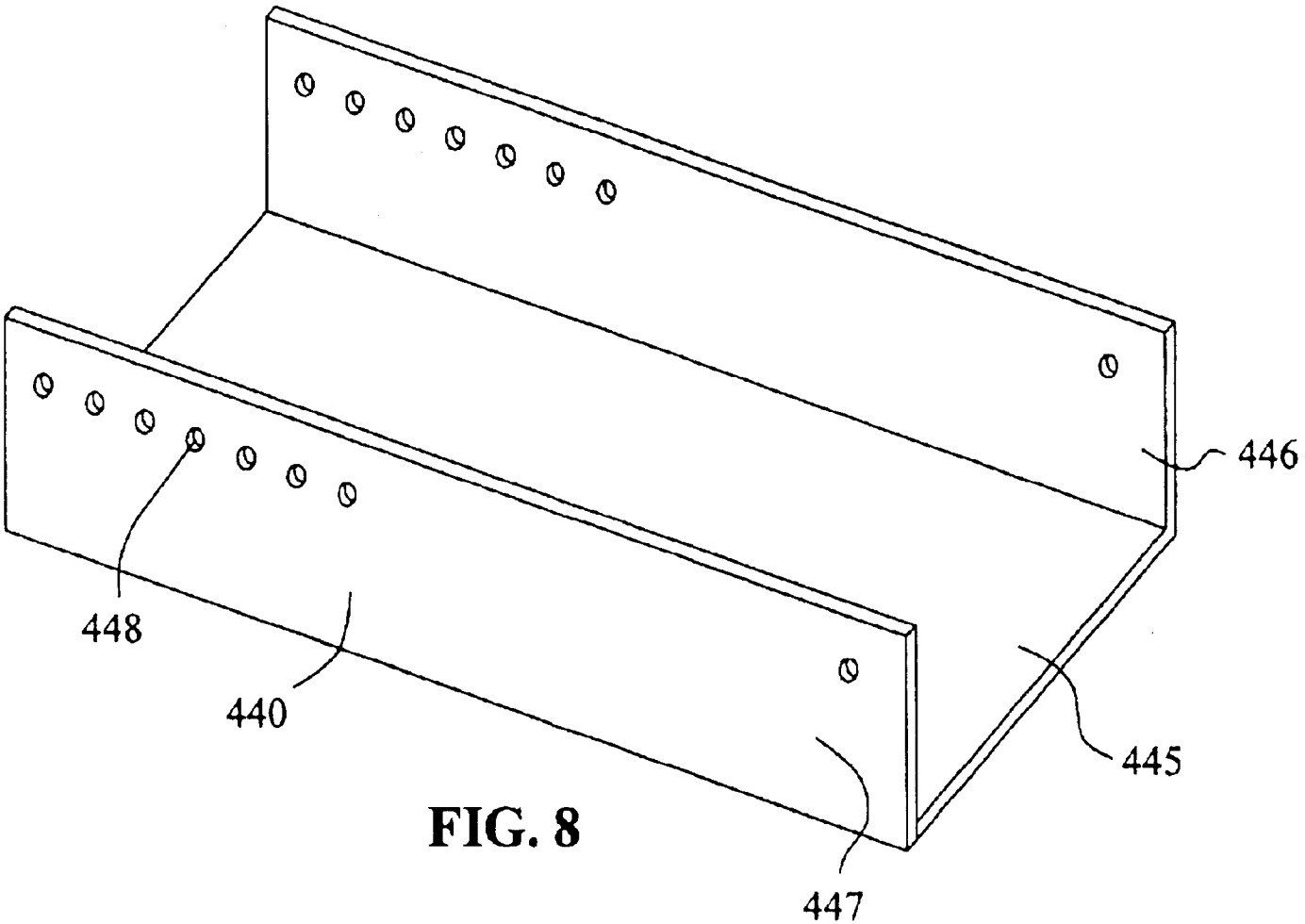
FIG. 8 is a perspective view of the hull support member of the boat supporting device.

Referring now to FIG. 8, there is shown the hull support member 440 in accordance with the present invention. As shown in FIG. 8, the hull support member 440 includes a bottom surface 445 and first and second sides 446 and 447. The first and second sides 446 and 447 further include a plurality of apertures 448 formed therein. The hull support member 440 is formed having a general U-shape, wherein the U-shape of the hull support member 440 is further configured to be received over the U-shaped channel of the base member 430 as shown in FIG. 5. Further still, as shown in FIG. 5, the hull support member 440 is further configured to be pivotally attached at one end to the base member 430, wherein an angle support member 450 as shown in FIG. 9 is attached at the second end of the hull support member and the base member 430. The angle at which the hull support member is affixed may be adjusted by moving the location of the angle adjustment member 450 along the base member 430, wherein the angle adjustment member 450 includes apertures 452 through which bolts may be disposed to affix the angle adjustment member 450 to the base member 430 and the hull support member 440.

In addition to that above, it shall be understood that the boat support device 400 maybe easily removed and attached to the first platform through the use of attachment means disposed within the apertures 432, 420 and the nut 407 attached to the platform support member 110. The attachment means may be a bolt or similar device. Further still, it is contemplated that at least one pin may be disposed through the at least one of the apertures 433 and 410 formed in the anchoring plate to provide a firmer attachment of the boat support device 400 to the boat lifting device. The pins may be configured to be removable from the apertures or the pins may be fixedly attached to the base member 430. Further still, it is contemplated that the pins may be replaced with additional bolts if desired. Alternatively, other boat supporting devices or cradles may also be used in combination with the boat lifting device. For example, a cradle may be used which allows a boat such as a dingy, to be received on the first platform with a motor remaining on and lifted completely out of the water.

The size of the platforms and vertical travel distance can be varied depending on the application. In one example, the first platform has a total vertical travel distance of about 40". In another example, the vertical travel of the first platform is about 45" to about 48". Preferably, the vertical travel distance is about 38" or greater.

Furthermore, it is contemplated that the lifting device 100 may be attached to other structures such as barges, piers, houseboats, or other similar structures.

While the forgoing detailed description has described the present invention in accordance with a preferred embodiment, it is to be understood that the above description is illustrative only and not limiting of the disclosed invention. It will be appreciated that one skilled in the art may make modifications to the invention disclosed herein without departing from the spirit and scope of the present invention.

What is claimed:

1. A lifting device for a boat, the lifting device comprising:

a first platform;

a plurality of linkage members, the plurality of linkage members configured to form at least two four-bar linkage assemblies, each four-bar linkage assembly having a first end pivotally attached to the first platform and a second end pivotally attached to a boat, wherein each four-bar linkage assembly forms two parallelogram linkages connected to each side of the first platform;

at least one hydraulic cylinder, said cylinder having a first end and second end, the first end being pivotally connectable to the structure of a boat and the second end pivotally attached to at least one linkage member;

a fluid device in communication with the hydraulic cylinders; and at least one load sharing member configured to span and connect to at least two of the four-bar linkages together to prevent uneven or tilted motion of the first platform.

2. The lifting device according to claim 1, wherein the load sharing member is a beam substantially parallel to and spaced from the first platform.

3. The lifting device according to claim 2, wherein the fluid device comprises a hydraulic pump, the hydraulic pump configured to provide pressurized fluid to the hydraulic cylinder.

4. The lifting device according to claim 3, wherein the lifting device further includes a control device to control the pressurized fluid to the hydraulic cylinder.

5. The lifting device according to claim 4, wherein the control device includes an electro-mechanical device including an electronic switch connected to a pressurized fluid control valve.

6. The lifting device according to claim 5, wherein the lifting device includes two hydraulic cylinders.

7. The lifting device according to claim 1, wherein each pair of four-bar linkages comprises a first four-bar linkage connected to the boat which acts as a parallelogram and a second four-bar linkage connected to the first four-bar linkage which acts as a parallelogram and maintains the first platform in a horizontal position.

8. A lifting device for a boat, the lifting device comprising:

a first platform;

a plurality of linkage members, the plurality of linkage members configured to form at least two four-bar linkage assemblies, each four-bar linkage assembly having a first end pivotally attached to the first platform and a second end pivotally attached to a boat;

at least one hydraulic cylinder, said cylinder having a first end and second end, the first end being pivotally connectable to the structure of a boat and the second end pivotally attached to at least one linkage member;

a fluid device in communication with the hydraulic cylinders, the fluid device comprises a hydraulic pump, the hydraulic pump configured to provide pressurized fluid to the hydraulic cylinder; and at least one load sharing member configured to span and connect to at least two of the four-bar linkages together to prevent uneven or tilted motion of the first platform, wherein the load sharing member is a beam substantially parallel to and spaced from the first platform; and wherein the lifting device further includes a second platform, the second platform pivotally connected to the boat and four-bar linkage assemblies.

9. The lifting device according to claim 1, wherein the first platform is configured to receive a watercraft thereon.

10. The lifting device according to claim 1, wherein the first platform is constructed of plastic.

11. The lifting device according to claim 1, wherein the first platform is constructed of fiberglass.

12. The lifting device according to claim 8, wherein the load sharing member is a beam substantially parallel to and spaced from the first platform.

13. The lifting device according to claim 12, wherein the fluid device comprises a hydraulic pump, the hydraulic pump configured to provide pressurized fluid to the hydraulic cylinder.

14. The lifting device according to claim 8, wherein the first platform is configured to receive a watercraft thereon.

15. The lifting device according to claim 8, wherein the first platform is constructed of plastic.

16. The lifting device according to claim 8, wherein the first platform is constructed of fiberglass.

17. The lifting device according to claim 13, wherein the lifting device further includes a control device to control the pressurized fluid to the hydraulic cylinder.

18. The lifting device according to claim 17, wherein the control device includes an electro-mechanical device including an electronic switch connected to a pressurized fluid control valve.

19. The lifting device according to claim 18, wherein the lifting device includes two hydraulic cylinders.

20. A lifting device for lifting a personal watercraft or boat, the lifting device comprising:

a first platform;

a plurality of linkage members, the plurality of linkage members configured to form at least two four-bar linkage assemblies, each four-bar linkage having a first end pivotally attached to the platform and a second end pivotally attached to a boat;

at least two force applying devices configured to raise and lower the two four-bar linkage assemblies, each force applying device having a first end and second end, the first end being pivotally connectable to the structure of a boat and the second end pivotally attached to at least one linkage member;

a second platform, the second platform pivotally connected to the two four-bar linkage assemblies; and a control device in communication with the two force applying devices, the control device configured to control the motion of the each of the two force applying devices.

21. The lifting device according to claim 20, wherein the two force applying devices are hydraulic cylinders.

22. The lifting device according to claim 20, wherein the two force applying devices are linear actuators.

23. The lifting device according to claim 20, wherein the two force applying devices are motor and screw assemblies.

24. The lifting device according to claim 21, wherein the control device includes a fluid pump configured to provide pressurized fluid to the hydraulic cylinders.

25. The lifting device according to claim 20, wherein the lifting device further includes a load sharing member, the load sharing member connected at each end to one of the four-bar linkages and being configured to form a rigid connection between the two four-bar linkage assemblies.

26. The lifting device according to claim 25, wherein the load sharing member is a square member.

27. The lifting device according to claim 20, wherein the linkage members are constructed of stainless steel.

28. The lifting device according to claim 20, wherein the linkage members are constructed of steel.

29. The lifting device according to claim 20, wherein the linkage members are constructed of aluminum.

30. The lifting device according to claim 20, wherein the linkage members are constructed of composite materials.

31. A lifting device for lifting a personal watercraft or boat, the lifting device comprising:

a first platform;

a second platform;

a plurality of linkage members;

at least one force applying device configured to raise and lower the first and second platforms, said force applying device having a first end and second end, the first end being pivotally connectable to a boat and the second end pivotally connected to at least one linkage member; and a control device in communication with the force applying device, the control device configured to control the motion of the force applying device, whereby the force applying device and control device are configured to move both the first platform and the second platform from a raised position to a lowered position, wherein when the second platform is moved from a raised position to a lowered position, the second platform is moved less than half a distance the first platform is moved from the raised position to the lowered position.

32. The lifting device according to claim 31, wherein the lifting device further includes a load sharing member, the load sharing member connected at each end to one of the four-bar linkages and being configured to form a rigid connection between the two four-bar linkage assemblies.

33. The lifting device according to claim 32, wherein the lifting device includes two force applying devices.

34. The lifting device according to claim 33, wherein the lifting device further includes a boat supporting device, the boat supporting device comprising a base member, a hull support member and an angle support member.

35. The lifting device according to claim 34, wherein the hull support member is pivotally attached at one end to the base member and fixedly attached to the base member at the other end by the angle support member.

36. The lifting device according to claim 34, wherein the boat supporting device is removably attached to the first platform.

* * * * *